United States Patent [19]

Zelinka et al.

[11] Patent Number: 4,911,600

[45] **Date of Patent: * Mar. 27, 1990**

[54] LIFTING DEVICE

[75] Inventors: Robert F. Zelinka; John W. Redding, both of Roselle, Ill.

[73] Assignee: Perkins Manufacturing Company, Chicago, Ill.

[ * ] Notice: The portion of the term of this patent subsequent to May 3, 2005 has been disclaimed.

[21] Appl. No.: 126,593

[22] Filed: Nov. 30, 1987

Related U.S. Application Data

[63] Continuation of Ser. No. 862,015, May 12, 1986, Pat. No. 4,741,658, which is a continuation of Ser. No. 572,389, Jan. 20, 1984, abandoned.

[51] Int. Cl.[4] ..... B65F 3/02

[52] U.S. Cl. ..... 414/408; 414/406; 414/421

[58] Field of Search ..... 414/406, 407, 408, 411, 414/404, 405, 419, 420, 421, 422, 423, 424, 425, 539, 540, 541, 546, 555, 558

[56] References Cited

U.S. PATENT DOCUMENTS

| | | | |
|---|---|---|---|
| 3,738,516 | 6/1973 | Wells . | |
| 3,804,277 | 4/1974 | Brown et al. | 414/303 |
| 3,884,376 | 5/1975 | Rivers | 414/421 |
| 3,894,642 | 7/1975 | Shive | 414/303 |
| 4,042,137 | 8/1977 | Hughes et al. . | |
| 4,365,922 | 12/1982 | Borders | 414/406 |
| 4,422,814 | 12/1983 | Borders | 414/421 X |
| 4,479,751 | 10/1984 | Wyman et al. | 414/421 X |
| 4,741,658 | 5/1988 | Zelinka et al. | 414/406 |

FOREIGN PATENT DOCUMENTS

| | | | |
|---|---|---|---|
| 622499 | 6/1961 | Canada | 414/422 |
| 811456 | 8/1951 | Fed. Rep. of Germany | 414/406 |
| 2146653 | 3/1973 | Fed. Rep. of Germany | 414/406 |
| 3024081 | 1/1981 | Fed. Rep. of Germany | 414/408 |
| 2479783 | 10/1981 | France | 414/408 |
| 2500425 | 8/1982 | France | 414/408 |
| 83/03242 | 9/1983 | PCT Int'l Appl. . | |

*Primary Examiner*—Frank E. Werner

*Attorney, Agent, or Firm*—Cook, Egan, McFarron & Manzo, Ltd.

[57] ABSTRACT

A lifter for emptying a container into a cavity of a vehicle. The lifter has a first plate pivotally connected to the vehicle, and a second plate extending at an angle from the first plate. The lifter has a third plate slidably mounted on the second plate, with the third plate having a pair of hooks to grasp bars on the container. The lifter moves between a first lower position beneath the truck to a second upper position with the container located above the cavity to empty the container into the cavity.

16 Claims, 3 Drawing Sheets

FIG. 1
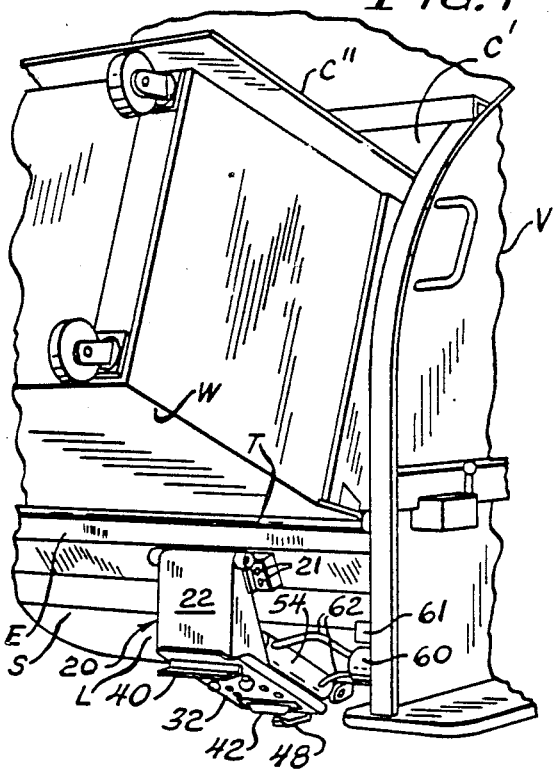
FIG. 2
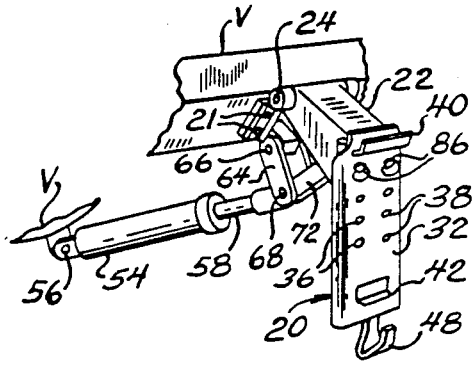
FIG. 5
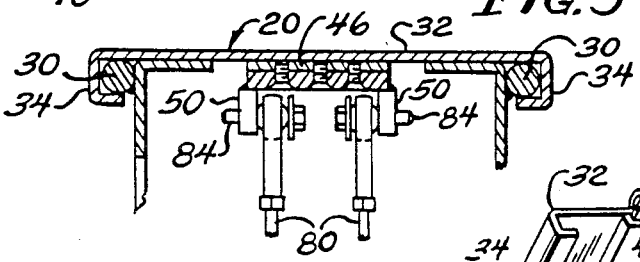
FIG. 3
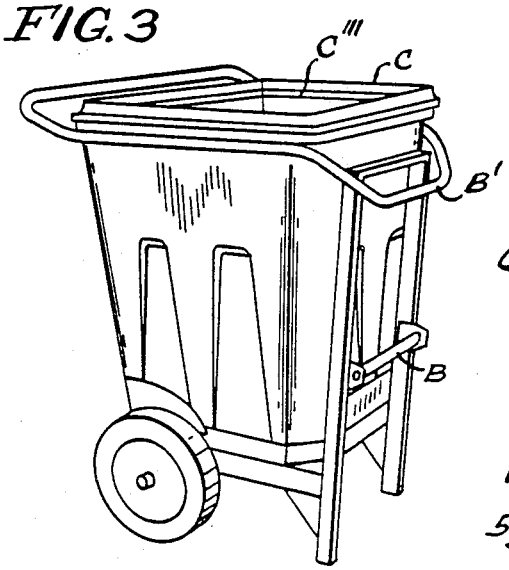
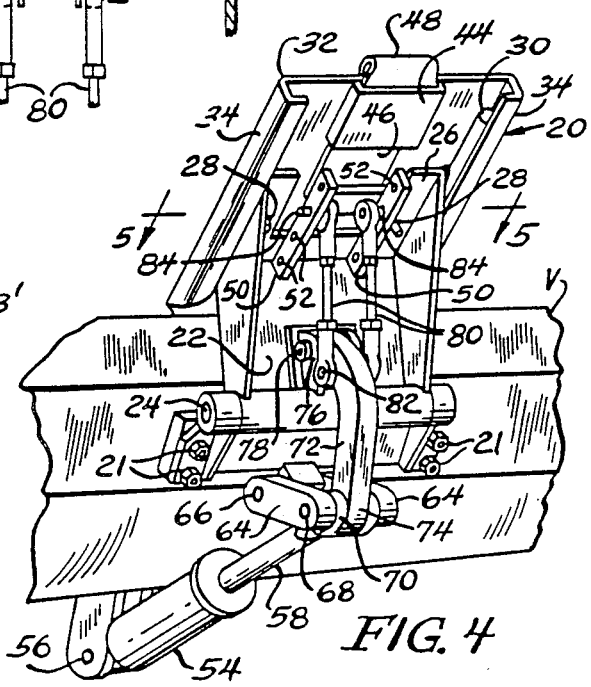
FIG. 4

LIFTING DEVICE

This is a continuation of application Ser. No. 862,015, filed May 12, 1986 which issued May 3, 1988 as U.S. Pat. No. 4,741,658, which is a continuation of application Ser. No. 572,389, filed January 20, 1984, now abandoned.

BACKGROUND OF THE INVENTION

The present invention relates to lifting devices.

Before the present invention, lifting devices have been proposed for dumping containers into the cavity of a vehicle, such as refuse trucks. An initial problem with prior devices is that they are large and cumbersome. Also, the prior lifters have prevented access to the vehicle for pivot dumping large rear loading containers. One prior device folds to a side of the vehicle to permit access to the vehicle, but the device obstructs traffic in this position.

SUMMARY OF THE INVENTION

A principal feature of the present invention is the provision of an improved lifter for emptying a container into a cavity of a vehicle which does not interfere with access for pivot dumping large rear loading containers.

In a preferred embodiment, the lifter of the present invention comprises a first plate pivotally mounted to the vehicle, and a second plate extending at an angle from the first plate. The lifter has a third plate slidably mounted on the second plate, with the third plate having a pair of spaced hooks. The lifter has means for driving the plates and hooks between a first lower, retracted position to a a series of second upper position.

A feature of the present invention is that in the first position the lifter is located beneath the vehicle.

Thus, a feature of the present invention is that when the lifter is at the first position access is permitted to the vehicle in order to dump a large rear loading container into the vehicle.

Another feature of the invention is that the hooks grasp bars on the container as the lifter moves between the first and second positions.

Yet another feature of the invention is that the lifter places the container above the cavity at the second position in order to empty the container into the vehicle cavity.

A further feature of the invention is that one of the hooks clamp on the container bar to prevent the container from falling into the cavity while it is being emptied.

Still another feature of the invention is that the hooks are adjustable in height on the lifter.

Thus, a further feature of the invention is that the lifter may be adjusted to accommodate changes in the truck as refuse is dumped into the vehicle or differences in height when the vehicle is located on a hill.

Further features will become more fully apparent in the following description of the embodiments of this invention and from the appended claims.

DESCRIPTION OF THE DRAWINGS

In the drawings:

FIG. 1 is a fragmentary perspective view illustrating a lifter of the present invention in a first lower position;

FIG. 2 is a fragmentary perspective view of the lifter of FIG. 1;

FIG. 3 is a perspective view of a container which is emptied into a vehicle by the lifter of the present invention;

FIG. 4 is a fragmentary perspective view of the lifter in a second upper position;

FIG. 5 is a fragmentary sectional view taken substantially as indicated along the line 5—5 of FIG. 4;

DESCRIPTION OF THE PREFERRED EMBODIMENTS

Figure 6:
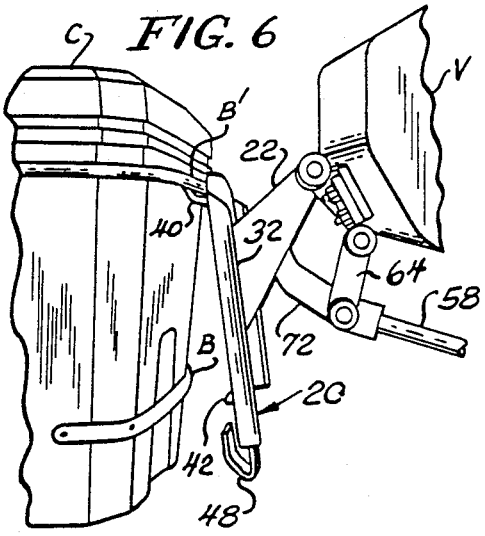
FIGS. 6–8 are fragmentary perspective views illustrating the lifter in operation to empty the container into the vehicles.

Referring now to FIG. 1, there is shown a lifter 20 of the present invention which is mounted by bolts 21 on the rear of a vehicle V such as a refuse truck. Although the lifter 20 is shown mounted on the right rear side of the vehicle V, it will be understood that another lifter of the same type may be mounted on the left side of the vehicle V. The vehicle V has a hopper container still S defining a lower portion of a rearwardly facing opening to the cavity C' to receive and retain refuse. The sill S has a lower portion L slanting upwardly and rearwardly to a leading sill edge E over which the refuse is dumped. As shown FIG. 1, the lifter 20 is located at a first, or lower, position beneath the the sill S of the vehicle V, with the lifter 20 being mounted by the bolts 21 adjacent but beneath the edge E of the sill S to permit horizontal access to the edge E from the edge E to the ground. The lifter 20 of the present invention is utilized to empty a first type of containers C of FIG. 3 into the cavity C' of the vehicle V of a type which are too short to matingly engage the sill and thus must be lifted above the sill. With reference to FIG. 1, with the lifter 20 in its lower, or retracted, position the lifter 20 is located sufficiently beneath the sill S, such that, access at a level vertically beneath the edge E to the ground is permitted to the sill S at the rear of the vehicle in order to empty large rear loading containers C" of the type which are tall enough to be unloaded by tilting without lifting, as shown in FIG. 1, in a tilted position. Before and after dumping of the container C", the front wall W of the container C" extends substantially vertically from the sill edge E toward the ground. The container C" has an elongated trunion bar T at an uppermost portion of the container C" which is located adjacent to the sill edge when the container C" is dumped, as shown in FIG. 1. Thus, in accordance with the present invention, the lifter 20 lifts and tilts small containers without interfering with the emptying of large containers into the vehicle V.

With reference to FIG. 3, the container C with which the lifter 20 operates has a lower front bar B and an upper front bar B'. The container C has a chamber C''' with an open top into which refuse is dumped by the user for storage until the container C is emptied into the vehicle V of FIG. 1.

With reference to FIGS. 1, 2, 4, and 5, the lifter 20 has a first plate 22 having an inner end pivotally connected at 24 to the rear of the vehicle V adjacent the cavity C'. The lifter 20 has a second plate 26 extending at an angle from an outer end of the first plate 22. The second plate 26 has a pair of spaced apertures 28 extending therethrough for a purpose which will be described below. Also, the second plate 26 has a pair of spaced rods 30 at opposed sides of the second plate 26 and extending along the second plate 26.

The lifter 20 has a third plate 32 having a pair of flanges 34 at opposed sides of the third plate 32 and partially extending around the rods 30 of the second plate 26, such that the third plate 32 is slidably mounted on the second plate 26. The third plate 32 has a first set of openings 36 aligned along the third plate 32, and a second set of openings 38 aligned along the length of the third plate 32, such that the openings 36 and 38 register with the apertures 28 of the second plate 26. The third plate 32 has an upper outwardly directed hook or hook member 40 adjacent an inner end of the third plate 32. The third plate 32 also has an outwardly directed flange 42 adjacent an outer end of the third plate 32.

The third plate 32 has an inner tunnel 44 adjacent an outer end of the third plate 32. The third plate 32 has hook means comprising a tongue 46 slidably received in the tunnel 44, and a hook or hook member 48 extending from an outer end of the tongue 46 and being directed toward the flange 42. The lifter 20 has a pair of elongated opposed flanges 50 connected to an inner end of the tongue 46, with the flanges 50 having a plurality of apertures 52 spaced along their length.

The lifter 20 has a hydraulic cylinder 54 having one end pivotally connected at 56 beneath the vehicle. The cylinder 54 has a piston 58 which may move in and out of the cylinder 54. The piston 58 of the cylinder 54 is driven by a pump 60 through conduits 62, with the pump 60 being driven by a motor 61 which is powered by the electrical system of the vehicle V.

The lifter 20 has a pair of link arms 64 having an inner end pivotally connected at 66 to the vehicle V, and outer ends pivotally connected at 68 to an outer end 70 of the piston 58. The lifter 20 has an arcuate arm 72 having one end 74 pivotally connected to the outer end 70 of the piston 58 and outer ends of the link arms 64 at connection 68, and the other end 76 pivotally connected at 78 to an inner end of the first plate 22.

The lifter 20 has a pair of rods 80 having one end pivotally connected at 82 to a central portion of the arcuate arm 72 intermediate the pivotal connections 68 and 78. The other ends of the rods 80 have pins 84 which are pivotally received in selected apertures 52 of the flanges 50.

Figure 7:
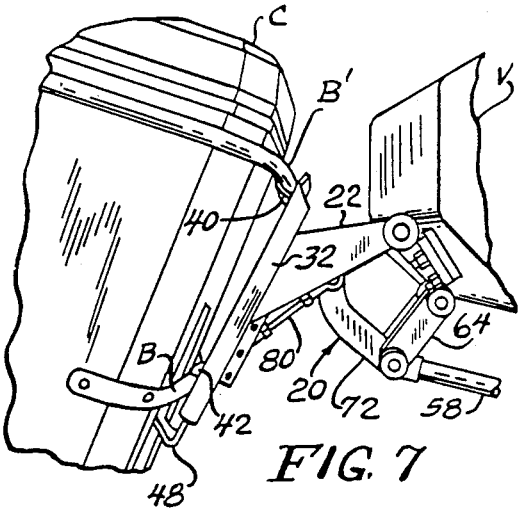
Figure 8:
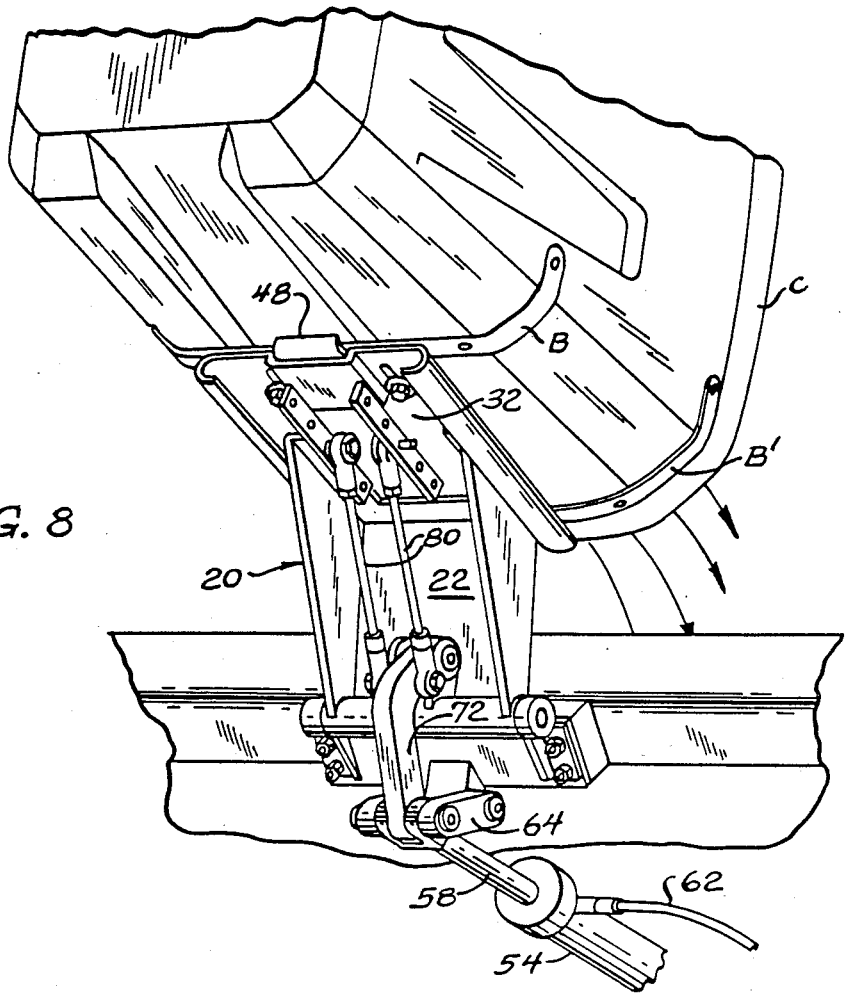

In operation, the lifter 20 is initially located in a first lower position beneath the vehicle V, as shown in FIG. 1. In this configuration, the hook 48 is spaced from the flange 42. Prior to use of the lifter 20, the container C of FIG. 3 is moved to a position behind the lifter 20. With reference to FIG. 6, as the cylinder 54 is operated by the pump 60 and motor 61 to drive the piston 58 out of the cylinder 54, the lifter 20 moves from beneath the truck and the hook 40 initially catches the upper bar B′ of the container C. With reference to FIG. 7, as the piston 58 is driven further from the cylinder 54, the lower bar B of the container C is received between the hook 48 and the flange 42. Next, as the cylinder 54 further drives the lifter 20 in an upward direction, the hook 48 moves toward the flange 42 in order to clamp the lower bar B of container C between the hook 48 and flange 42 and prevent the container C from falling into the cavity C′ of the vehicle V. Finally, with reference to FIG. 8, the lifter 20 is driven to a second upper position with the container C located above the cavity C′ of the vehicle V in an upside down orientation in order to empty the container C into the cavity C′ of the vehicle V. After the container C has been emptied into the vehicle V, the lifter 20 is driven from the second upper position to the first lower position while the hook 48 moves away from the flange 42 in order to release the lower bar B of the container C. In this manner, the lifter 20 of the present invention may be readily and simply used in order to empty the container C into the cavity C′ of the vehicle V.

Figure 9:
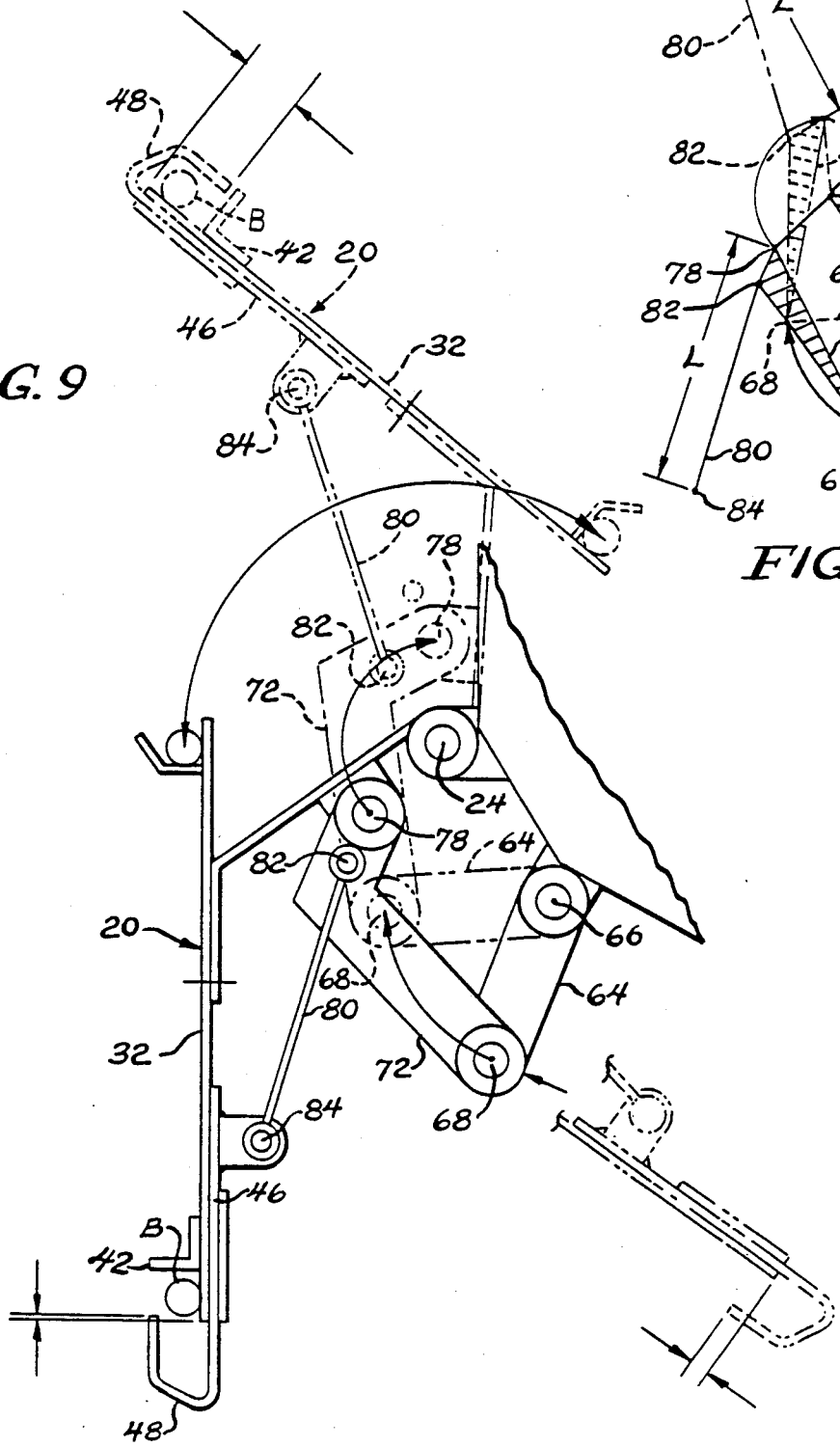
FIGS. 9 and 10 are diagrammatic views illustrating operation of the lifter of the present invention.
Figure 10:
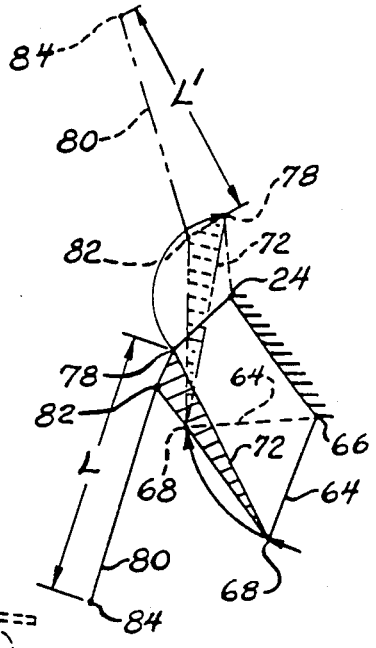

The manner in which the hook 48 is moved toward and away from the flange 42 during movement of the lifter 20 will be discussed in connection with FIGS. 9 and 10 where the lifter 20 is shown in solid lines in a lower position and in dotted lines in an upper position. As shown, the pivotal connections 78, 82, and 84 are located on nearly a straight line at the lower position of the lifter 20 and define a distance L between the connections 78 and 84. In the upper position of the lifter 20, the connections 78, 82, and 84 form a triangle to define the distance L′. Therefore, it will be apparent that the distance L′ between the connections 78 and 84 is less in the upper position of the lifter 20 than the distance L in the lower position of the lifter 20. Accordingly, the rods 80 pull on the tongue 46 as the distance between connections 78 and84 lessens while the lifter 20 rises, and the tongue 46 moves the hook 48 over the bar B as the lifter 20 rises and the distance L shortens. In this manner, the hook 48 is clamped on the bar B as the lifter 20 moves toward its upper position. In a preferred form, the hook 48 clamps on the bar B when the lifter 20 is approximately in a horizontal position. In reverse, as the lifter 20 lowers from its upper position the distance L′ increases and the rods 80 move the tongue 46 and hook 48 toward an outer position in order to release the bar B. In this manner, the lifter 20 of the present invention clamps the bar B of the container C as the lifter rises to its second upper position in order to prevent the container from falling into the cavity C′ of the vehicle as the container C is emptied.

As refuse is placed in the cavity C′ of the vehicle V, the vehicle V settles and the height of the hooks 48 and 40 may change with respect to the bars of the container C. Also, when the vehicle is placed on a hill, the height of the hooks 48 and 40 may change relative to the bars of the container C. In accordance with the present invention, the height of the hooks 48 and 40 may be adjusted relative to the bars B and B′ of the container C to accommodate these changes. The openings 36 and 38 of the third plate 32 may be selectively positioned in register with the apertures 28 of the second plate 26 as the third plate 32 is slid relative to the second plate 26. Once the selected openings 36 and 38 are in register with the apertures 28, a pair of pins 86 are placed through the openings 36 and 38 and the apertures 28 in order to retain the third plate 32 in place relative to the second plate 26. Prior to adjustment of the third plate 32, the pins 84 of the rods 80 are removed from the apertures 52 of the flanges 50, and the pins 84 are then inserted into different apertures 52 of the flanges 50 depending upon the location of the third plate 32. Of course, the position of the hooks 48 and 40 are fixed with respect to the third plate 32, and thus the height of the hooks 48 and 40 are adjusted relative to the container C through adjustment of the position of the third plate 32 in the manner described.

Thus, in accordance with the present invention, the lifter 20 may be positioned beneath the vehicle V to permit access to the vehicle V and empty large rear loading containers into the vehicle V. Also, the lifter 20 grasps a container C during movement to a second upper position in order to empty the container C into the vehicle V. In accordance with the invention, the lifter 20 has a hook 48 which clamps on a bar B of the container C during upward movement of the lifter 20, in order to prevent the container C from falling into the cavity C' of the vehicle V as the container C is being emptied, and the hook 48 automatically releases the bar B of the container C as the lifter 20 moves from its upper to lower position. Also, the height of hooks 48 and 40 of the lifter 20 may be adjusted relative to the bars B and B' of the container C such that the hooks 48 and 40 appropriately grasp the bars B and B' on the container C during operation of the lifter 20.

The foregoing detailed description is given for clearness of understanding only, and no unnecessary limitations should be understood therefrom, as modifications will be obvious to those skilled in the art.

We claim:

1. Receptacle dumping apparatus attachable to a refuse collection vehicle of the type having a refuse receiving cavity including sidewalls and a floor extending upwardly to a lower still edge, said dumping apparatus comprising:

a receptacle lifter comprising means for capturing and releasing a portion of a receptacle;

means for pivotally mounting said receptacle lifter below the sill edge of the refuse collection vehicle;

means for moving said lifter between a first lifter position and a second lifter position, said lifter being located substantially entirely below a horizontal plane tangent to said sill edge and substantially entirely on the cavity side of a vertical plane tangent to said sill edge when in said first position, wherein lateral access to the sill edge from a side of said vertical plane opposite said refuse receiving cavity is substantially obstructed, and said lifter being located above the sill edge when in said second position, for dumping a receptacle;

said means for capturing and releasing said receptacle portion comprising first and second projections, at least one of said first and second projections being movable between a capture position for capturing said receptacle portion therebetween and a release position for releasing said receptacle portion;

means cooperatively associated with said lifter moving means and said capture and release means for moving said capture and release means to said capture position as said lifter is moved from said first position to said second position and for moving said capture and release means to said release position as said lifter is moved from said second position to said first position.

2. Receptacle dumping apparatus in accordance with claim 1 further comprising means for selectively adjusting the vertical position of said second projection on said lifter so as to accommodate receptacle portions of various heights.

3. Receptacle dumping apparatus in accordance with claim 1 wherein said second projection is a plate movably attached to said lifter.

4. Receptacle dumping apparatus in accordance with claim 1 wherein said second projection further comprises a plurality of spaced attachment points for selective attachment of said means for moving said capture and release means.

5. Receptacle dumping apparatus in accordance with claim 1 further comprising a third projection on said lifter for engaging another portion of said receptacle.

6. A refuse collection vehicle comprising:

means defining a refuse receiving cavity, including side walls and a lower wall extending upwardly to a lower sill edge;

a receptacle lifter movably mounted below said sill edge, said lifter including means for capturing a portion of a selected type of receptacle;

means cooperatively associated with said lifter for moving said lifter between a first lifter position and a second lifter position, said lifter being located substantially entirely below a horizontal plane tangent to said sill edge and substantially entirely on the cavity side o a vertical plane tangent to said sill edge when in said first position, whereby the area below and outwardly of said sill edge is substantially unobstructed by said lifter and lateral access to the sill edge from a side of said vertical plane opposite said means defining a refuse receiving cavity, for moving other types of containers and the like into close association with the sill edge, is substantially unimpaired, and said lifter being located above and outwardly of said sill edge when in said second position for dumping a selected type of receptacle;

said means for capturing a portion of a selected type of receptacle being movable between a capture position for capturing a portion of the selected type of receptacle and a release position for releasing the receptacle portion; and means cooperatively associated with said lifter moving means and said capture means for moving said capture means between said release and capture positions as said lifter moves between said first and second positions.

7. A refuse collection vehicle in association with claim 6 wherein said lifter is pivotally mounted below the sill edge, and said means for moving said lifter comprises a first link pivotally attached to said lifter, means defining an arc along which a portion of said first link may move, and means for moving said first link along said arc and thereby pivot said lifter between said first and second positions, and wherein said means for moving said capture means comprises a second link attached to said first link and to said capture means and adapted to move said capture means between said release and capture positions as said lifter moves between said first and second positions.

8. A refuse collection vehicle in accordance with claim 7, wherein said second link is attached to said first link so as to move toward or away from said capture means as said lifter moves between said first and second positions.

9. A refuse collection vehicle in accordance with claim 8 wherein said first and second links are pivotally attached at a location spaced from a line connecting the point of pivotal attachment of said first link to said lifter and said portion of said first link which may move in an arc.

10. A refuse collection vehicle in accordance with claim 7, wherein said means defining an arc comprises a third link pivotally attached to said vehicle and to said second link.

11. A refuse collection vehicle in accordance with claim 6 wherein said means for moving said lifter comprises an arcuate link pivotally attached to said lifter and another link pivotally attached to said vehicle and to said arcuate link, and wherein said means for moving said capture means includes a rod pivotally attached to said capture means and to said arcuate link, said arcuate link and said rod being pivotally attached at a point spaced from a line connecting the points of attachment of said arcuate link to said lifter and to said other link.

12. A refuse collection vehicle in accordance with claim 6 wherein said lifter further comprises first and second plates fixedly joined at an interior obtuse angle, said first plate being pivotally attached to said vehicle below said sill edge, and said second plate carrying said capture means, said means for moving said lifter being cooperatively attached to said first plate and adapted to move said plates to said first position wherein said second plate is located below and inwardly of said sill edge to permit unimpaired access to said sill edge.

13. A refuse collection vehicle in accordance with claim 12 wherein said means for moving said lifter comprises a first link pivotally attached to said first plate, means defining an arc along which a portion of said first link may move, and means for moving said first link along said arc thereby moving said lifter between said first and second positions, and wherein said means for moving said capture means comprises a second link attached to said first link and to said capture means and adapted to move said capture means between said release and capture positions as said lifter moves between said first and second positions.

14. A refuse collection vehicle in accordance with claim 13, wherein said second link is attached to said first link so as to move toward or away from said capture means, as said lifter moves between said first and second positions.

15. A refuse collection vehicle in accordance with claim 13, wherein said means defining an arc comprises a third link pivotally attached to said vehicle and to said second link.

16. A refuse collection vehicle in accordance with claim 13 wherein said first and second links are pivotally attached at a location spaced from a line connecting the point of pivotal attachment of said first link to said lifter and said portion of said first link which may move in an arc.

* * * * *

UNITED STATES PATENT AND TRADEMARK OFFICE

CERTIFICATE OF CORRECTION

PATENT NO. : 4,911,600

DATED : March 27, 1990

INVENTOR(S) : Robert F. Zelinka; John W. Redding

It is certified that error appears in the above-identified patent and that said Letters Patent is hereby corrected as shown below:

Column 5, line 36, change "obstructed" to -- unobstructed --.

Signed and Sealed this

Seventeenth Day of March, 1992

*Attest:*

HARRY F. MANBECK, JR.

*Attesting Officer*

*Commissioner of Patents and Trademarks*